US005517840A

United States Patent [19]

Häggström

[11] Patent Number: 5,517,840

[45] Date of Patent: May 21, 1996

[54] CYLINDER LOCK-KEY COMBINATION WHICH INCLUDES A SIDE BAR; AND A LOCK KEY

[75] Inventor: Åke Häggström, Lycksele, Sweden

[73] Assignee: Assa AB, Eskilstuna, Sweden

[21] Appl. No.: 244,320

[22] PCT Filed: Dec. 18, 1992

[86] PCT No.: PCT/SE92/00881

§ 371 Date: Jun. 2, 1994

§ 102(e) Date: Jun. 2, 1994

[87] PCT Pub. No.: WO93/12313

PCT Pub. Date: Jun. 24, 1993

[30] Foreign Application Priority Data

Dec. 19, 1991 [SE] Sweden ..... 9103780

[51] Int. Cl.[6] ..... E05B 19/06

[52] U.S. Cl. ..... 70/495; 70/496

[58] Field of Search ..... 70/494, 495, 496, 70/389

[56] References Cited

U.S. PATENT DOCUMENTS

| | | | |
|---|---|---|---|
| Re. 31,910 | 6/1985 | Oliver | 70/494 |
| 3,264,852 | 8/1966 | Gysin . | |
| 3,418,833 | 12/1968 | Kerr | 70/389 |
| 4,393,673 | 7/1983 | Widen | 70/358 |
| 4,723,427 | 2/1988 | Oliver | 70/494 |
| 4,998,426 | 3/1991 | Genakis | 70/494 |
| 5,067,335 | 11/1991 | Widén | 70/495 |
| 5,375,444 | 12/1994 | Smith | 70/495 |

FOREIGN PATENT DOCUMENTS

| | | |
|---|---|---|
| 371883 | 8/1983 | Germany . |
| 380861 | 11/1975 | Sweden . |

*Primary Examiner*—Steven N. Meyers
*Assistant Examiner*—Gary Estremsky
*Attorney, Agent, or Firm*—Sughrue, Mion, Zinn, Macpeak & Seas

[57] ABSTRACT

A cylinder lock-key combination includes a cylinder housing (2) and a plug (3) provided with a key slot (3*a*). A row of pin tumblers (5) coact with a side bar (6) in a manner to prevent the side bar moving to its release position unless the correct key (4) is inserted into its operative position in the plug (3). The side bar (6) is activated at the ends of the side bar by one or more driving pins (7) which coact with the key side surface and which are guided in the plug for movement at right angles to the plane of the key slot (3*a*) and which function to press the side bar to its locking position as the key is withdrawn from its operative position.

10 Claims, 6 Drawing Sheets

CYLINDER LOCK-KEY COMBINATION WHICH INCLUDES A SIDE BAR; AND A LOCK KEY

FIELD OF INVENTION

The present invention relates to a cylinder lock-key combination which includes a side bar, and more specifically to a cylinder lock-key combination of the kind defined in the preamble of the following claim 1.

The invention also relates to a key for operating such a combination.

BACKGROUND ART

U.S. Pat. No. 4,393,673 (Widén) describes a cylinder lock provided with a side bar and pin tumblers of the aforesaid kind, in which the bottom surfaces of the rotatable pin tumblers are intended to coact with a coded, shouldered side part of the key. The coded surfaces engage with a segment-shaped part of the bottoms of respective pin tumblers, and curved transition parts whose radii correspond to the radii of the pin tumblers are provided between the coded surfaces of the key.

The side bar is spring-biased outwardly from the cylinder, into engagement with a recess in the lock housing, this recess being configured to urge the side bar into the cylinder plug upon rotation thereof, after having inserted the correct key into an operative position in the plug. The side bar includes a number of lugs having rounded engagement surfaces which coact with waisted parts of the side bar. In manufacture, the coded surfaces and the intermediate transition surfaces must be produced very accurately, and consequently the cylinder lock taught by this prior publication is comparatively expensive in manufacture.

U.S. Pat. No. 3,264,852 (Gysin) teaches a cylinder lock with which there is used a key which is provided on the side surfaces thereof with grooves which, when the key is inserted to an operative position in the plug, coact with tumblers that have outwardly projecting pins which engage in respective grooves. The tumblers of this lock do not coact with a side bar. Moreover, the pins on the tumblers are subjected to a relatively high degree of wear, which is liable to jeopardize the function of the cylinder lock after long-time use.

Other examples of the state of the prior art with regard to lock keys are found in SE B 380,861 (Winkhaus) and AU B 371,883 (Prunbauer).

OBJECT OF THE INVENTION

One object of the present invention is to provide a cylinder lock-key combination provided with a side bar in which it is ensured that the side bar will be moved positively, or forcibly, into its locking position.

Another object of the present invention is to provide a cylinder lock-key combination which can be manufactured simply and the mutually coacting, moveable parts of which will only be subjected to a small degree of friction, causing only a slight degree of wear to these moveable parts and achieving continued reliable function of the combination over a long period of use.

Another object of the invention is to provide a combination of the aforesaid kind which will function smoothly and effectively even in difficult environments, for instance when the lock is exposed to moisture and/or cold.

A further object of the invention is to provide a cylinder lock of small dimensions which will nevertheless provide an extraordinary large number of possible combinations, therewith making it difficult to force the lock or to open the lock unless using a correct key.

DISCLOSURE OF THE INVENTION

These and other objects are fulfilled with an inventive cylinder lock-key combination of the aforesaid kind which is mainly characterized by the features set forth in the characterizing clause of claim 1.

The side bar is thus moved forcibly, so as to ensure that it will function reliably. Furthermore, because the driving pins are guided for movement in the plug, jamming is prevented as the side bar is moved.

It is conceivable in some cases to provide only one single driving pin, although it is normally preferred to provide one driving pin at each end of the side bar.

The driving pins may optionally be surrounded by springs, so as to facilitate and assist movement of the side bar to its locking position.

In order to ensure that the driving pins will function as intended, the ends of the pins distal from the side bar will preferably engage in a corresponding recess or notch in the key when the key is fully inserted. The ends of the driving pins that enter the recess are preferably tapered conically to form a pointed tip, which facilitates the purpose of the driving pins to urge the side bar into its locking position as the key is withdrawn from its operative position. In other words, the tips of the driving pins are moved up out of said recesses as the key is withdrawn, therewith moving the side bar forcibly into its locking position.

In one embodiment, the pin tumblers are provided with a circular flange and the side surface of the key is provided with a groove whose width varies along the length thereof for accommodation of the pin tumbler flanges.

When the key is inserted into its operative position, the tumbler flanges will be gripped by both sides of the groove in the side surface of the key, so that the pin tumblers are moved forcibly to respective code positions. At the same time, the tumblers are able to rotate in the plug, meaning therefore that the groove engagement surfaces will vary and therewith cause only a slight degree of wear on the tumbler flanges.

The friction between mutually coacting components is relatively small, particularly in those cases when the tumblers are not acted upon by springs. This increases the length of useful life of the lock.

The forcibly guided movement of the tumblers means that the tumblers need not be spring-activated. However, springs which, for instance, engage the tops of the tumblers to ensure that the tumblers will move to desired positions when the key is withdrawn may be provided.

In practice, the groove will preferably include parts which extend straight and parallel with the key insertion direction and which normally define the code positions of the pin tumblers, and intermediate, angled transition parts of greater width.

This double engagement of the tumbler flanges, on both the top and the bottom surfaces thereof, results in more accurate positioning of the tumblers in respective code positions. The intermediate, angled transition parts of the groove of greater widths offer only slight resistance to key movement when the key is inserted into and withdrawn from the plug.

The concept of the invention, however, also includes the possibility of defining one or more code positions in the angled transition parts of the key. Movement of the pin tumblers at right angles to the direction in which the key is inserted is very precise, insofar as the pin tumblers take a definable position in the movement plane of the pins in each key position. The provision of a code position in an angled transition part renders it difficult to determine the code positions of the key.

The tip of the key may have a widening end-region adjacent the groove. This ensures that when the key is moved to an operative position in the plug, the groove will capture all of the pin flanges, irrespective of their positions. To this end, the end of the key may conveniently be provided with a V-shaped recess or notch delimited by a corresponding V-shaped shoulder part which converges with the groove at the apex of the V.

In order to ensure reliable function, it is preferred that the side bar is activated by one or more driving pins which coact with the side surface of the key and which are guided for movement in the plug at right angles to the plane of the key slot and which function to press the side bar out to its locking position when the key is withdrawn from its operative position with the side bar in its release position.

In this connection, in order to ensure that the driving pins and the side bar will function smoothly and effectively, the straight, normal code positions of the key groove are extended along a distance which exceeds the radius of the driving pins, as in accordance with one preferred embodiment of the invention. The pin tumblers will therewith remain in their code positions during the initial phase of withdrawing the key, during which the driving pins, as they leave their respective apertures or recesses, will urge the side bar in a direction generally at right angles to the key withdrawal direction.

Normally, these extended parts of the code positions will correspond roughly to the diameter of the driving pins, therewith ensuring that the desired movement sequence is carried out correctly.

The driving pin aperture or apertures in the key is/are preferably formed in conjunction with manufacturing the key blank. Thus, the apertures, or recesses, may be formed in direct conjunction with clipping the key blank from a metal plate.

However, instead of being provided with apertures or recesses of this kind, the key blank may be provided with depressions or hollows whose depths correspond to or exceed the penetration depth of the member, e.g. the tongue, on the side member in corresponding members, e.g. the waisted part of respective tumblers. This will ensure that the side bar correctly leaves its release position and is forcibly guided to its locking position as the key is withdrawn. The key cannot be turned unless these apertures, recesses or depressions are correctly positioned. The apertures, recesses or depressions may be differently placed, e.g. for the classification of different series of cylinder locks.

The plug space can be utilized to the best effect when the other side of the key is also grooved for coaction with a further row of pin tumblers and a side bar in the plug.

It will be understood that the number of code combinations for the lock concerned can be increased exponentially in this way. It is also possible to allow the edge surface of the key between the two grooved side surfaces thereof to coact with pin tumblers of a more or less conventional kind, thereby further increasing the combination possibilities of the lock.

In the case of one particular application of the invention, the key slot provided in the plug can accommodate two different keys each for coaction with respective pin tumblers accommodated in each plug half, each of these pins, in turn, coacting with a respective side bar in the aforedescribed manner.

In such cases, a lock of this kind can be used when two persons are authorized to open a lock in unison, each of these persons having one of the keys in his/-her charge. In this case, it is impossible to open the lock unless both persons are present with their respective keys.

The invention also relates to a key of a combination of the aforedescribed kind, the main characteristic features of the key being set forth in the characterizing clause of claim 9.

An inventive key of the kind defined in claim 9 will enable the pin tumblers to remain in their code positions during the initial phase of withdrawing the key. This special key function will ensure that the lock as a whole will operate smoothly and efficiently, namely because the driving pins urge the side bar in a direction towards the locking position before the pin tumblers are permitted to move from their code positions.

The positioning of the apertures, recesses or depressions can serve as an extra code.

The invention will now be described in more detail with reference to exemplifying embodiments thereof and also with reference to the accompanying drawings.

DESCRIPTION OF PREFERRED EMBODIMENTS

Figure 1:
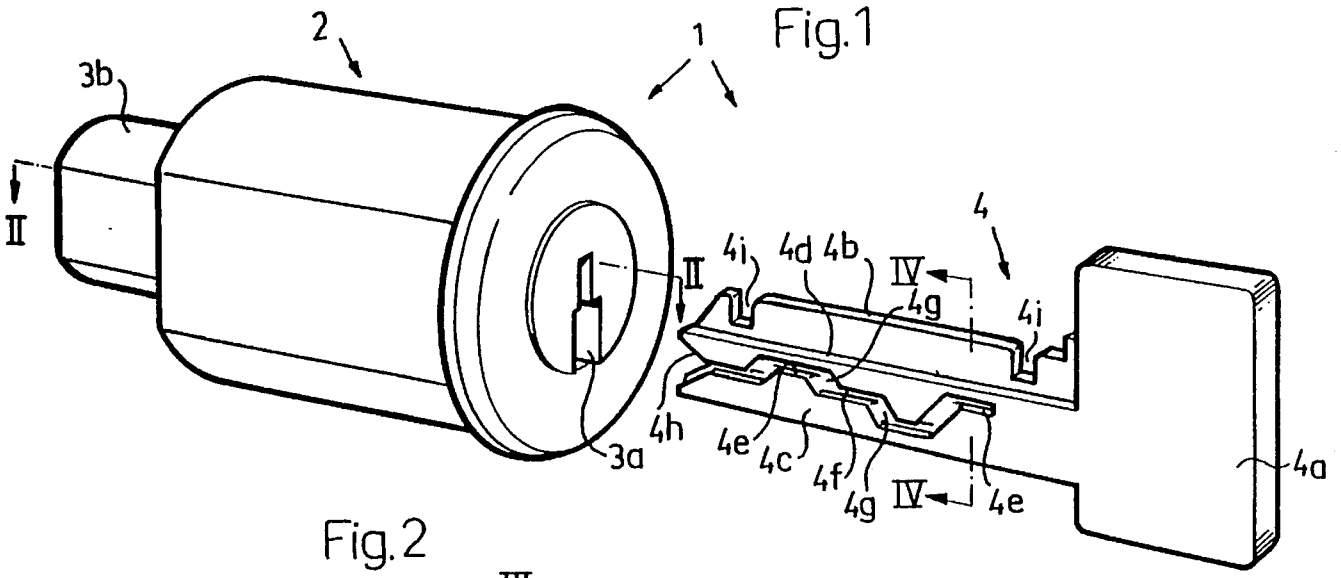
FIG. 1 is a perspective view of an inventive combination, comprising a lock cylinder and an associated key.

FIG. 1 illustrates a cylinder lock-key combination which comprises of a lock cylinder 2 and a key 4. The lock cylinder 2 accommodates a plug 3 provided with a key slot 3*a*.

Figure 2:
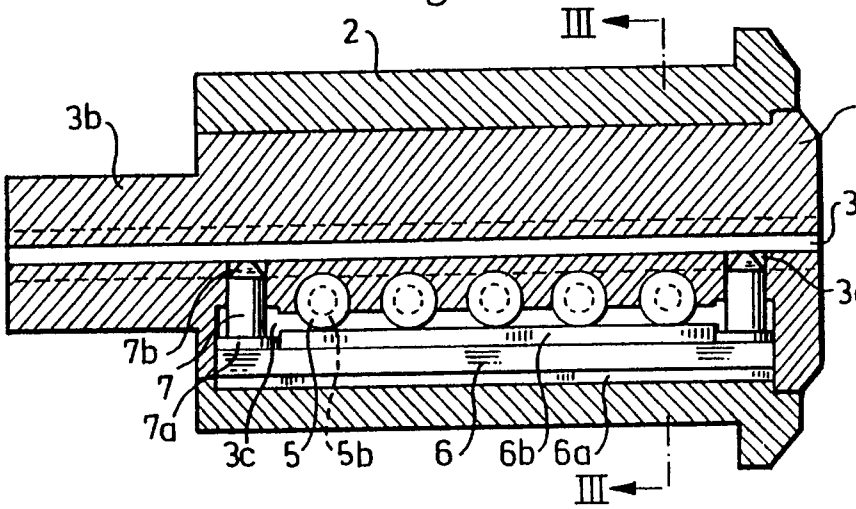
FIG. 2 is a sectional view of the lock cylinder shown in FIG. 1, taken on the line II—II.
Figure 3:
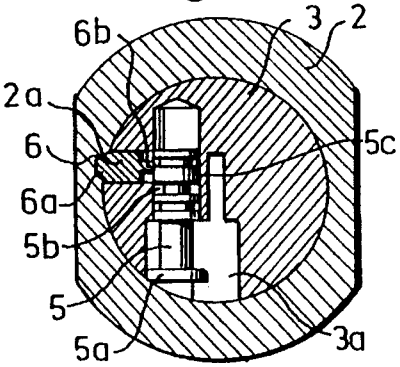
FIG. 3 is a sectional view of the lock cylinder shown in FIG. 2, taken on the line III—III.
Figure 4:
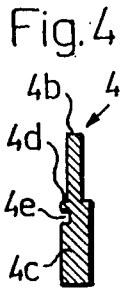
FIG. 4 is a sectional view of the key shown in FIG. 1, taken on the line IV—IV.

As shown in FIGS. 2 and 3, the plug 3 accommodates a row of pin tumblers 5 whose axes lie in a plane which is parallel with the plane of the key slot 3*a* and spaced from said plane. The pin tumblers 5 are moveable in said plane and can be twisted or turned around their axes.

The pin tumblers 5 are provided at their respective bottom ends with a flange 5*a* which is received in a groove 4*f* in the side surface 4*c* of the key 4. The configuration of the groove will be described in more detail herebelow.

The plug 3 also includes an aperture 3*c* which accommodates a side bar 6. The side bar 6 coacts with the pin tumblers 5 and is moveable in said aperture in a plane that extends at right angles to the plane of the pin tumblers, although it may define an angle other than a right angle relative to this plane.

The side bar has a narrowing forward part 6*a* which is accommodated in a correspondingly shaped aperture 2*a* in the lock cylinder 2. One long side of the side bar has a tongue 6*b* which is intended to engage a waisted part 5*b* in respective pin tumblers 5. FIG. 3 shows the side bar 6 in its locking position, in which the tongue 6*b* does not engage a waisted part 5*b*, therewith enabling the side bar 6 to freely leave its locking position. The pin tumbler 5 will not take a position in which the side bar 6 is able to move to its release position until the correct key 4 has been inserted in its operative position in the slot.

The key 4 has an upper edge surface 4*b* which may be optionally provided with a code (not shown) in a conventional manner, for coaction with an additional pin tumbler (not shown) mounted in the plug.

The key 4 includes a key grip 4*a* and a shoulder 4*d* that forms an upper defining surface of a side part 4*c* in which the aforesaid groove 4*f* is formed for coaction with the flanges 5*a* on respective pin tumblers 5.

The width of the groove 4*f* varies and the groove includes a number of straight code parts 4*e* and intermediate angled transition parts 4*g* whose widths are greater than the code parts 4*e*.

The groove widens outwardly at the tip of the key, as indicated at 4*h*, so as to ensure that the flanges 5*a* of the pin tumblers 5 will be engaged by the groove.

When the key 4 is inserted, the groove 4*f* will engage both the upper and the lower sides of the flanges 5*a* on the pin tumblers 5 and therefore force the tumblers to move to their respective code positions.

The plug 3 is provided with bores 3*e* in the region of the ends of the side bar 6, for accommodating driving pins 7 having heads 7*a* which engage respective end-parts of the side bar 6. The ends of the driving pins 7 which face towards the key slot 3*a* narrow conically and are intended to be received in apertures 4*i* in the end regions of the blade part of the key 4 as the side bar moves to its release position.

Figure 5:
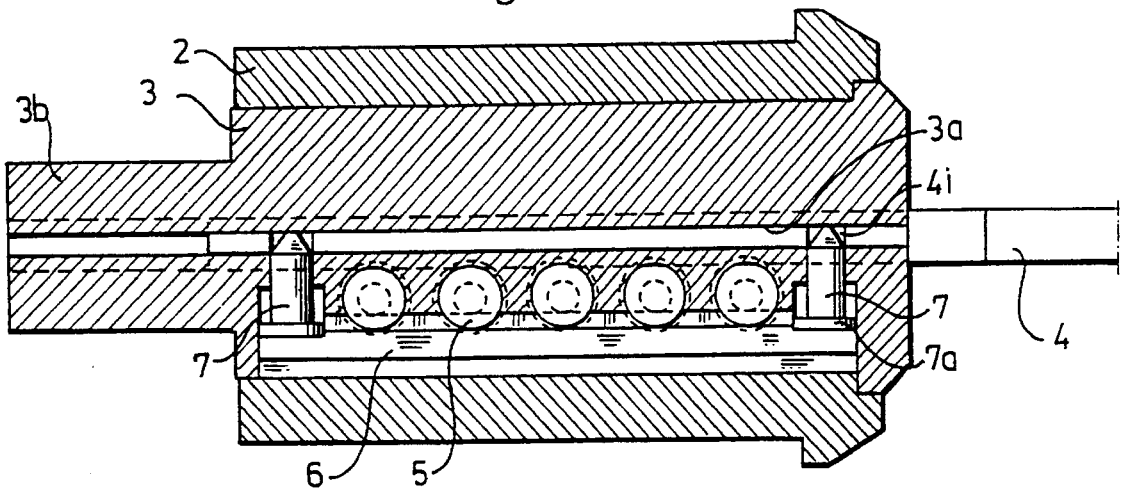
FIG. 5 is a sectional view of the lock cylinder shown in FIGS. 1–3 subsequent to having inserted the key and turning the key through 90°.

The driving pins 7 are also intended to move the side bar 6 forcibly to its locking position. FIG. 5 is a sectional view of a lock cylinder according to FIGS. 2 and 3, with the key inserted and turned through 90°. In this operational state of the lock, the side bar 6 is in its release position and the conical ends 7*b* of the driving pins 7 are located in the recesses or notches 4*i* in the key 4.

Figure 6:
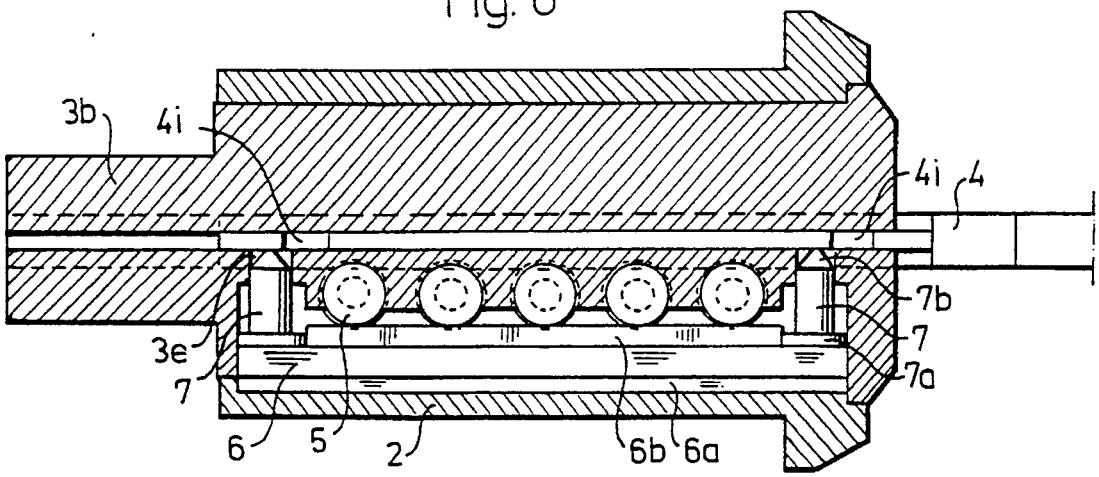
FIG. 6 is a sectional view corresponding to FIG. 5, subsequent to commencing withdrawal of the key from its operative position.

FIG. 6 is a view which corresponds to FIG. 5 and which illustrates initial withdrawal of the key from its operative position. Thus, the key 4 has been withdrawn through a distance which slightly exceeds the radius of the driving pin 7. The tips 7*b* of the driving pins have therewith left the notches 4*i* in the key while moving at right angles thereto and urging the side bar 6 outwards to its locking position. The cylinder housing 2 includes an elongated aperture 2*a* for accommodating the side bar 6 in its locking position.

The driving pins 7 thus ensure that the side bar will be forcibly guided to its locking position as the key is withdrawn from the key slot 3*a*. In order to ensure that the pin tumblers 5 will not move from their code positions upon initial withdrawal of the key, the straight code positions 4*e* of the groove 4*f* are extended so that all pin tumblers 5 will remain in their respective code positions until the side bar has been pressed outwardly from its locking position by the driving pins 7.

The positions of respective waisted portions 5*b* of the pin tumblers 5 and the position of the tongue 6*b* on the side bar 6 may be varied.

Figure 7:
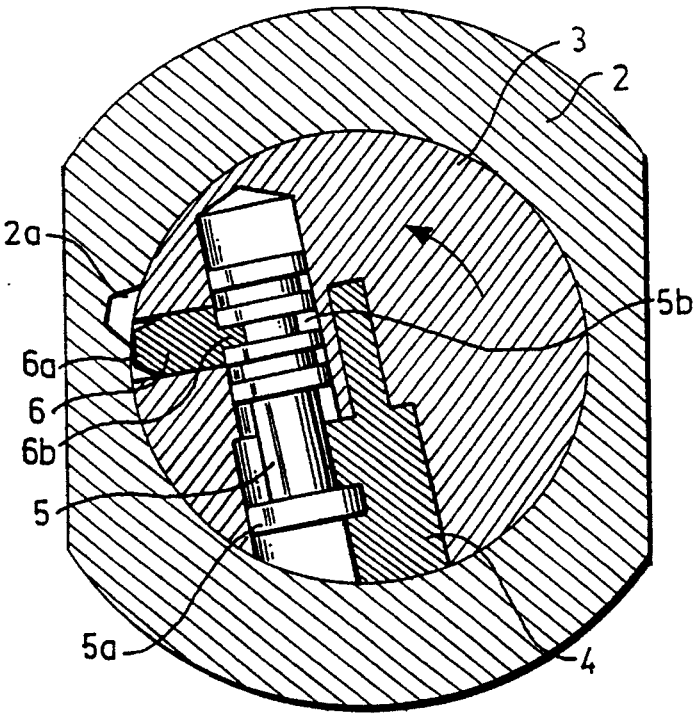
FIG. 7 is a sectional view corresponding to FIG. 2 with the key inserted and subsequent to commencing turning of the plug.

FIG. 7 shows the key 4 inserted to an operative position in the lock, wherein the pin tumblers 5 automatically take their coded positions in which the tongue 6*b* of the side bar 6 is able to enter the waisted portion 5*b*. As the plug 3 is turned by the key, the side bar 6 is pressed inwardly to the release position shown in FIG. 7, in which position the plug 3 can be turned.

Figure 8:
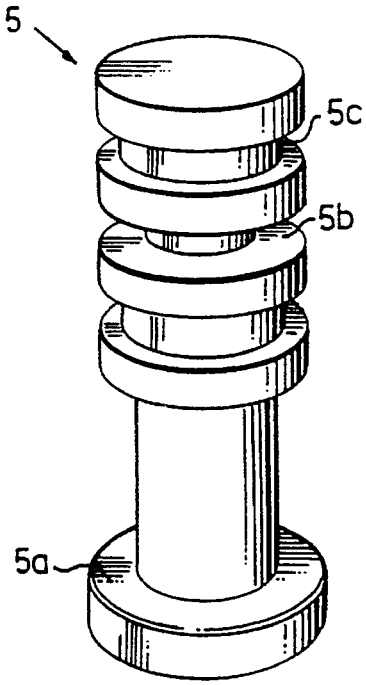
FIG. 8 is a perspective view of a pin tumbler.

FIG. 8 shows the pin tumbler 5, its flanges 5*a* and its waisted portion 5*b*. The illustrated pin tumbler also presents a number of "false" waisted portions 5*c* of smaller depth than the waisted portion 5*b*, to render forcing of the lock difficult.

Figure 9:
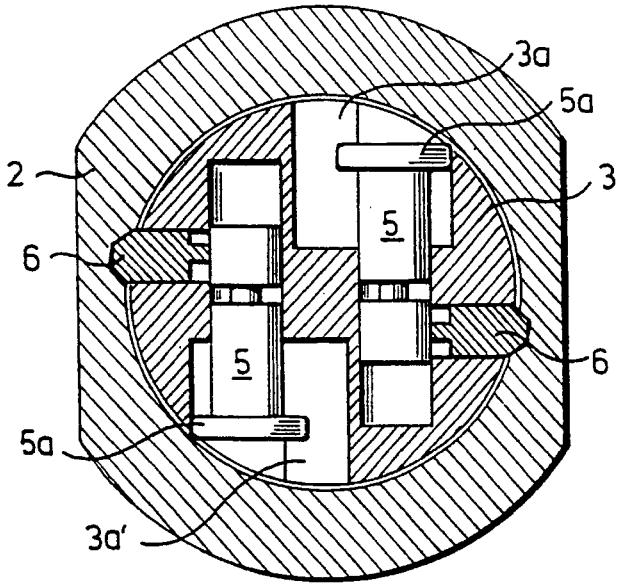
FIG. 9 is a sectional view corresponding to FIG. 3 and illustrates a modified embodiment in which the plug has two rows of pin tumblers, wherein the tumblers of each row are intended to coact with a respective side bar, and in which the key slot is intended to accommodate two keys.

FIG. 9 illustrates an embodiment in which two different keys must be inserted in the divided key slot 4*a*' in order to open the lock. Each of the keys (not shown) coacts with a pin tumbler/pin tumbler arrangement according to the earlier Figures. Alternatively, a single key in which the key blade is divided into two parts can be used instead.

Figure 10:
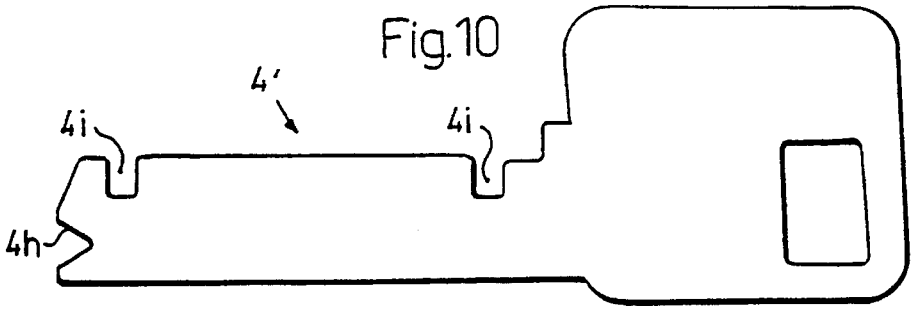
FIG. 10 is a side view of a key blank for the manufacture of a key of a combination constructed in accordance with the invention.

FIG. 10 illustrates a key blank from which a key for the lock illustrated in FIGS. 1–8 can be produced. The key blank is clipped from metal plate and has a key grip and a blade which is provided with the two notches or recesses 4*i* for coaction with the driving pins. The front end of the key blank has a V-shaped recess or notch 4*h* which forms a widened end-part of the groove formed in the side surface of the key blade.

Figure 11:
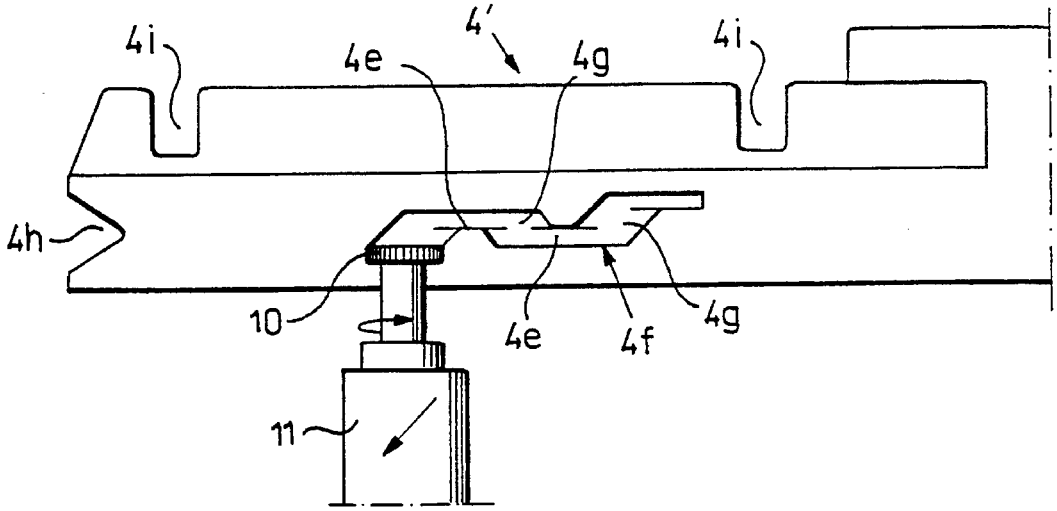
FIG. 11 illustrates the cutting of a groove in a key blank according to FIG. 10, such as to provide the blank with a side code.
Figure 12:
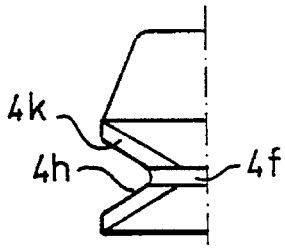
FIG. 12 illustrates the configuration of the groove in the vicinity of the tip of the key.

FIG. 11 illustrates the manufacture of a key from a key blank according to FIG. 10, and shows milling of a groove 4*f* of the type concerned with the aid of a milling tool 10 driven by drive means 11. The thickness of the milling tool 10 corresponds to the width of the groove 4*f* in the region of the straight code parts 4*e*. As the milling tool and/or the key blank move relative to one another, transition parts 4*g* are formed between the code parts 4*e*, these transition parts 4*g* having a greater width than the code parts 4e. The widened end region of the groove 4f is illustrated in more detail in FIG. 12, where the V-shaped parts of the groove are referenced 4k.

Figure 13:
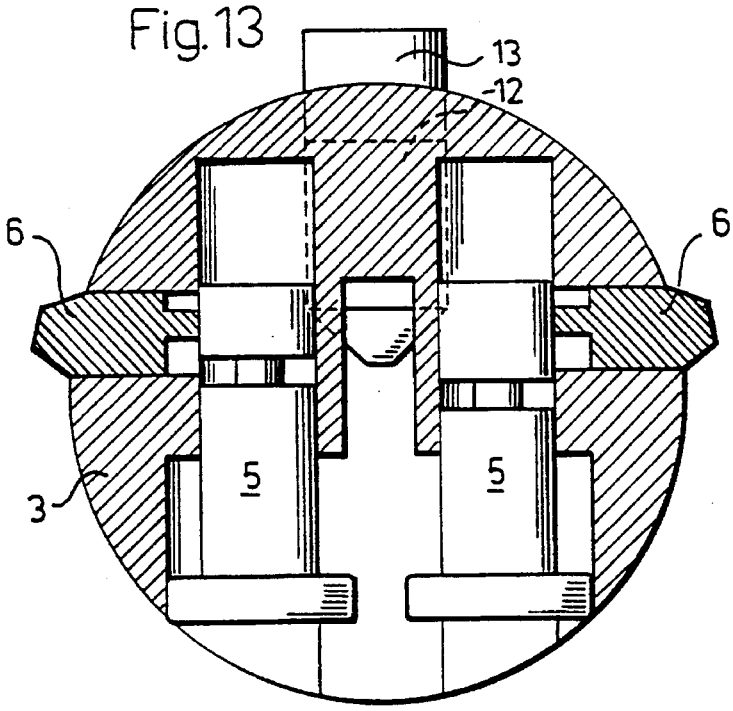
FIG. 13 is a sectional view corresponding to the view of FIG. 3 and illustrates a modified embodiment in which the cylinder plug is provided with double rows of pin tumblers and associated side bars and also top tumblers.

FIG. 13 is a cross-sectional view of a cylinder plug 3 having double rows of pin tumblers 5 and double side bars 6, wherein the edge part of the key (not shown) is also intended to coact with top tumblers 12, 13.

Figure 14:
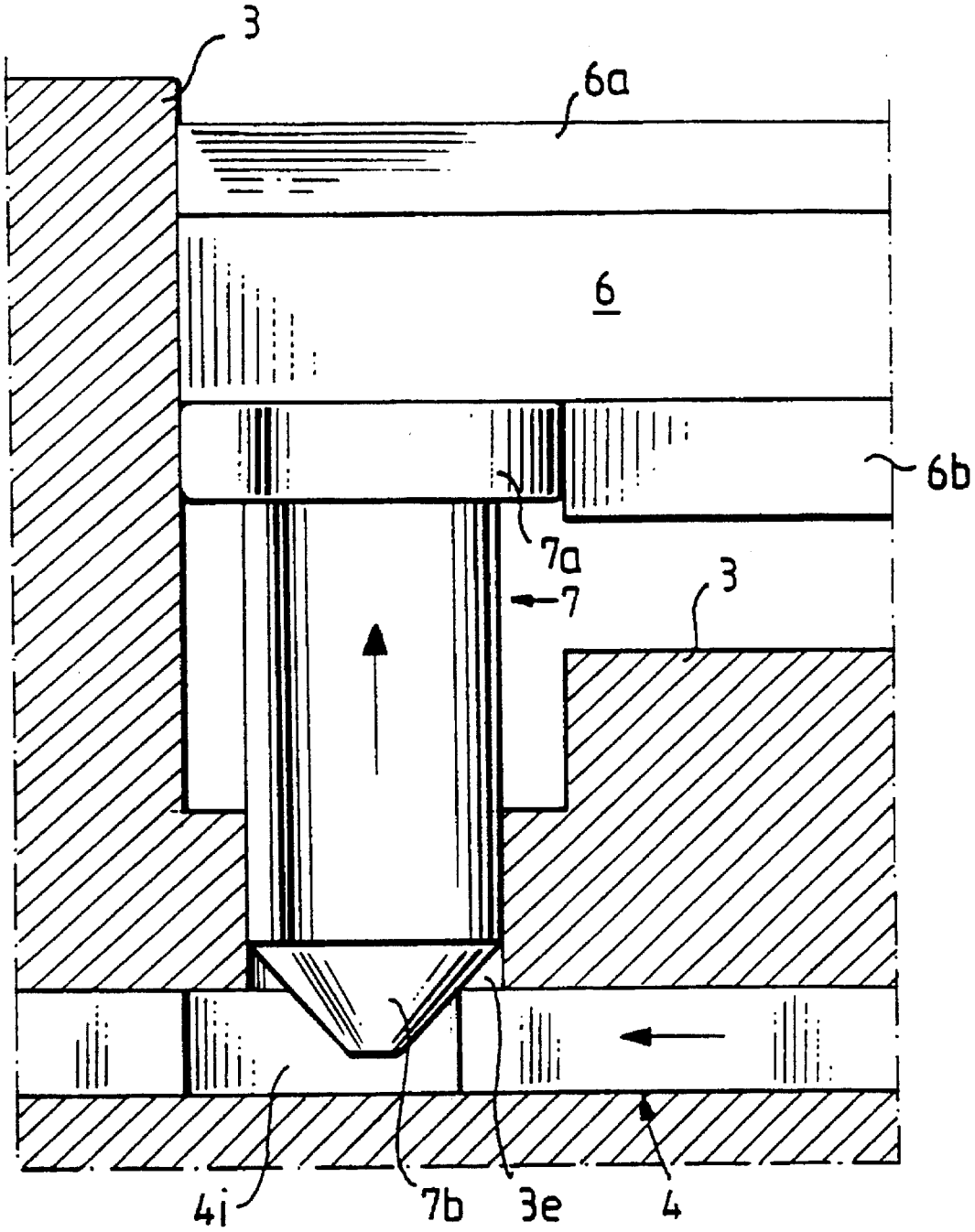
FIG. 14 is a detail sectional view in larger scale and shows how a first embodiment of a driving pin acts on the side bar for movement of the side bar to its locking position upon withdrawal of the key.

FIG. 14 is a detail sectional view in larger scale and illustrates a first embodiment of the driving pin 7, provided with a conical tip 7b. FIG. 14 also illustrates the manner in which the driving pin coacts with the recess 4i in the key 4, so as to press the side bar 6 into its locking position as the key is withdrawn.

The driving pin 7 is guided for movement in the bore 3e in the plug 3 and the head 7a of the driving pin is accommodated in a recess formed by termination of the tongue 6b at a distance from the edge of the side bar 6.

As the key is withdrawn in the direction of the arrow shown, the driving pin is moved at right angles to this direction, by engaging between the edge of the recess 4i and the conical tip 7b of the driving pin. The side bar 6 is therewith pressed into its locking position.

Although not shown, the driving pin 7 may be mounted within a spring (not shown) to assist this movement.

Figure 15:
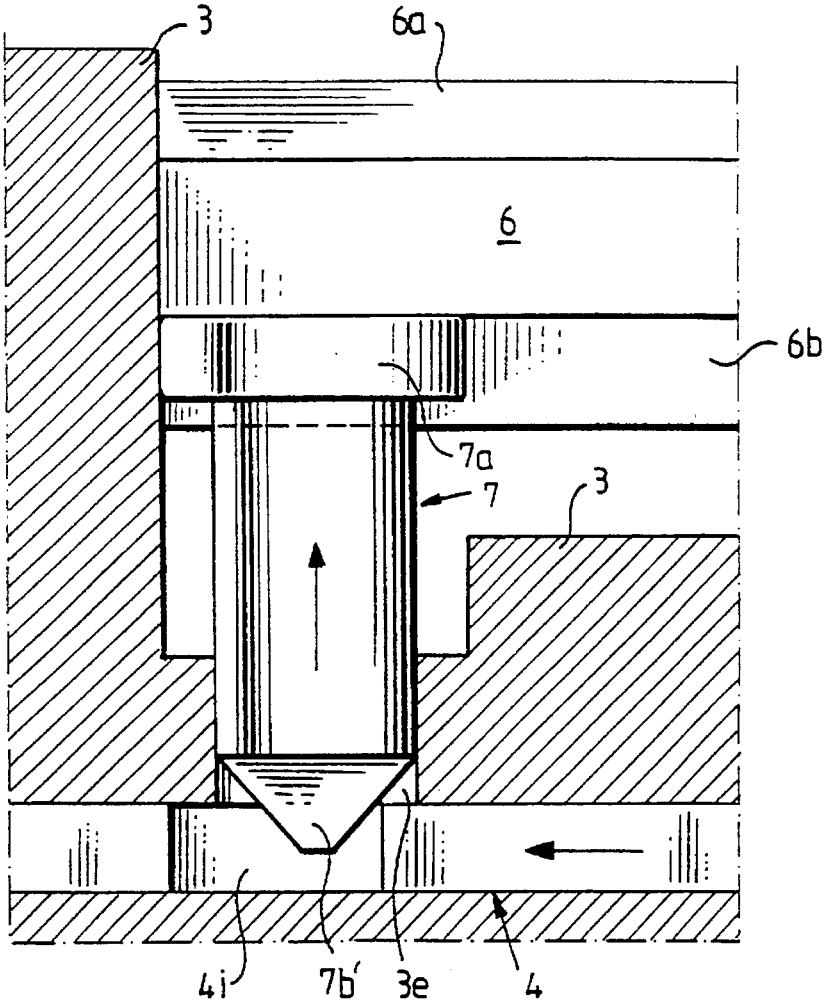
FIG. 15 is a corresponding detail sectional view of another embodiment.
Figure 16:
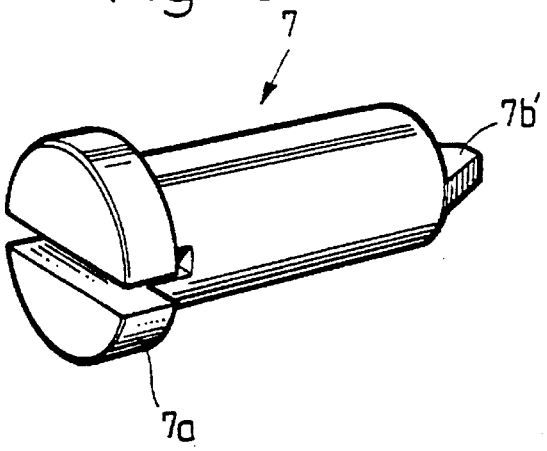
FIG. 16 is a perspective view of the driving pin used in the embodiment illustrated in FIG. 15.

In the embodiment illustrated in FIG. 15, there is used instead a driving pin 7 which has a flat tip 7b, shown in perspective in FIG. 16. This driving pin is caused to move in a corresponding manner, as the key 4 is withdrawn. In this case, the tongue 6b of the side bar 6 extends up to the edge of the side bar and the head 7a of the driving pin 7 has a groove in which the tongue 6b engages, so as to hold the driving pin against unintentional rotation. Movement of the driving pin 7 of this embodiment may also be assisted by means of a spring, not shown.

In the aforegoing, the side bar 6 and the coacting driving pins 7 have been described with a reference to a cylinder lock which is provided with flanged pin tumblers for coaction with a key having a grooved side surface. It will be understood, however, that in accordance with the invention, driving pins may coact with many other types of side bars and associated keys configured in other ways. One example in this respect is the cylinder lock taught by the aforesaid prior publication U.S. Pat. No. 4,393,673 (Widén), the side bar of which can coact with driving pins in principly the same manner as that described above. This also applies to side bars in other types of cylinder locks. The recesses 4i in the key whose positions correspond to the respective positions of the driving pins 7 will function as an extra lock code.

I claim:

1. A cylinder lock-key combination in which the cylinder lock (1) comprises:

a) a lock cylinder which is housed in a cylinder housing (2);

b) a plug (3) which is accommodated in the cylinder housing (2) and has a key slot (3a) and a row of pin tumblers (5) whose axes lie in a plane which is substantially parallel with the plane of the key slot and distanced therefrom, wherein the pin tumblers are operative to move in the pin tumbler plane and rotate about their axes when activated by the key (4);

c) a recess (3c) provided in the plug (3) and accommodating a side bar (6) which coacts with the pin tumblers (5) and is moveable in a plane extending substantially perpendicularly to the pin tumbler plane;

d) a groove (2a) in the cylinder housing (2) for receiving the side bar (6) in its locking position;

e) a lock element (6a) comprising a tongue on the side bar (6) for coaction with a corresponding lock element (5b) comprising one of a groove and a waisted portion on the pin tumblers in said tumbler row in the release position of the side bar, so that the side bar is operative to leave the groove (2a) in the cylinder housing (2) as the plug (3) is turned; and said key comprising:

f) a code formed on one side surface of the key and functioning to coact with the pin tumblers (5) in said tumbler row so that subsequent to inserting the key to its operative position in the key slot (3a), each pin tumbler will occupy a position which enables the side bar (6) to move to its release position and the plug (3) to be turned; wherein g) the side bar (6) is activated by at least one driving pin (7) which coacts with the key side surface and which is guided for movement in the plug perpendicular to the plane of the key slot (3a) and which when the key is withdrawn from its fully inserted position with the side bar (6) in its release position presses the side bar to its locking position.

2. A combination according to claim 1, wherein the end of the at least one driving pin (7) distal from the side bar (6) is received in a corresponding depression (4i) in the key (4) when the key is in its operative position.

3. A combination according to claim 1, wherein the pin tumblers (5) have a circular flange (5a) and the side surface of the key (4) has a groove (4f) whose width varies along its length and which receives the flanges of respective pin tumblers.

4. A combination according to claim 3, wherein the groove (4f) includes straight parts (4e) which extend parallel with the key insertion direction and which normally define the key code positions, and further includes intermediate, angled transition parts (4g) of greater width than said straight parts (4e).

5. A combination according to claim 4, wherein a code position is also defined by one or more of said transition parts (4g).

6. A combination according to claim 4, wherein the straight, normal code positions (4e) of the key groove (4f) are extended over a distance which exceeds the radius of respective driving pins (7).

7. A combination according to claim 2, wherein a depth of the depression (4i) in the key (4) which coacts with the at least one driving pin (7) corresponds to or exceeds the depth to which said tongue (6b) on the side bar (6) engages corresponding waisted portions (5c) of respective pin tumblers (5).

8. A combination according to claim 3, wherein the other side of the key (4) is also provided with a groove for coaction with a further row of pin tumblers (5) and a further side bar (6) in the plug (3).

9. A key pertaining to the combination according to claim 1, wherein a) a side surface of the key presents a plurality of depressions (4i) whose positions correspond to the positions of respective driving pins (7) when the key is inserted to its operative position in the plug (3);

b) the code located in the key side surface and intended for coaction with pin tumblers (5) in the plug includes straight code positions (4e) whose number corresponds to the number of pin tumblers; and wherein c) the code positions (4e) are extended through a distance which exceeds the radius of the driving pins and which preferably correspond approximately to the diameters of said driving pins.

10. A key according to claim 9, wherein the pin tumblers (5) have circular pin tumbler flanges (5*a*) and wherein at least one side surface is provided with a continuous groove (4*f*) having a number of defined code position parts (4*e*) which extend in the key insertion direction and the number of which corresponds to the number of pin tumblers (5) in the pin pin tumbler row in the plug (3); and in that located between the code position parts (4*e*) are transition parts (4*g*) whose breadth is greater than the breadth of the code position parts, the breadth of which corresponds to the thickness of the circular tumbler flanges (5*a*) and the width of which transition part (4*g*) is adapted to the circular pin tumbler flanges (5*a*).

* * * * *